US007306403B1

(12) United States Patent
Sanders

(10) Patent No.: US 7,306,403 B1
(45) Date of Patent: Dec. 11, 2007

(54) HEATED UNDERWATER DIVING SUIT

(76) Inventor: William M. Sanders, 47 W. Railroad Ave., Apt. #1, Gamerville, NY (US) 10923

( * ) Notice: Subject to any disclaimer, the term of this patent is extended or adjusted under 35 U.S.C. 154(b) by 32 days.

(21) Appl. No.: 11/406,785

(22) Filed: Apr. 19, 2006

(51) Int. Cl.
*B63C 11/28* (2006.01)

(52) U.S. Cl. ..... 405/186; 2/2.15; 2/2.16

(58) Field of Classification Search ..... 405/185, 405/186; 2/2.15–2.17
See application file for complete search history.

(56) References Cited

U.S. PATENT DOCUMENTS 3,449,761 A * 6/1969 Long ..... 2/2.15
3,675,244 A * 7/1972 Mayo et al. ..... 2/2.16
3,730,178 A * 5/1973 Moreland ..... 128/201.21
3,744,053 A * 7/1973 Parker et al. ..... 2/2.16
3,884,216 A * 5/1975 McCartney ..... 126/204
4,274,759 A * 6/1981 Long et al. ..... 405/186
5,960,469 A * 10/1999 Nuckols et al. ..... 2/2.16
6,120,530 A * 9/2000 Nuckols et al. ..... 405/186
6,415,453 B1 * 7/2002 Anderson et al. ..... 2/2.15
6,463,925 B2 * 10/2002 Nuckols et al. ..... 126/208
6,519,774 B2 * 2/2003 Mitchell ..... 2/2.15
2003/0024027 A1 * 2/2003 Godoy ..... 2/2.15

* cited by examiner

*Primary Examiner*—Frederick L. Lagman

(57) ABSTRACT

A self contained heated underwater diving suit having an inner liquid impervious yieldable sheet. An outer liquid impervious yieldable sheet is connected to the inner sheet. The inner sheet to the outer sheet forming a cavity therebetween. A silicon gel heating element is disposed within the cavity. A heating controller is electrically connected to the silicon gel heating element for controlling the heating of the silicon gel heating element.

20 Claims, 3 Drawing Sheets

HEATED UNDERWATER DIVING SUIT

BACKGROUND OF THE INVENTION

1. Field of the Invention

The present embodiment of the invention relates to a heated underwater diving suit for use in connection with diving suits. The heated underwater diving suit has particular utility in connection with self contained heated underwater diving suits having electronically controlled silicon gel heating elements.

2. Description of the Prior Art

Heated underwater diving suits are desirable for diving in water that would cause a diver harm from hypothermia. A need was felt for a diving suit that had a self contained heating circuit and silicon gel heating elements.

The use of diving suits is known in the prior art. For example, U.S. Pat. No. 5,960,469 to Nuckols et al. discloses a liquid-insulated garment for cold water diving supplements the inherent thermal protection of traditional suit insulations in conventional passive diving suits with bladders containing insulating liquids having substantially the same densities as water and thermal conductivities of less than 0.070 Btu/ft-hr.degree. F. to provide insulation from ambient cold. The additional thermal protection created by the liquid-insulated garment helps the diver surpass the performance and acceptable duration constraints imposed by conventional drysuits or wetsuits and allows easy adjustments to the level of thermal comfort required by the diver. It additionally reduces the inherent buoyant forces associated with conventional drysuits and wetsuits, and provides uniform thermal protection over the entire surface of the diver's body since it is tailored to fit the diver. Furthermore, the liquid-insulated garment is not only useful to enhance the effectiveness of diving operations, but also in other places where additional thermal protection is needed. However, the Nuckols et al. '469 patent does not have silicon gel heating elements controlled by an electronic heating circuit.

Similarly, U.S. Pat. No. 3,744,053 to Parker et al. discloses a liquid loop garment that provides thermal protection to the body of a user in hostile temperature environments. First and second superimposed liquid impervious yieldable sheets are secured together at select potions to form liquid barriers at preselected positions between the first and second sheets. The barriers and sheets define adjacent liquid channels which act to direct flow of a heat transfer medium passed into the garment. Inlet and outlet manifolds are each connected with a plurality of the channels so that heat transfer liquid can be passed into an inlet valve and distributed over the body of an individual with efficient control of temperature variations win the garment. However, the Parker et al. '053 patent does not have silicon gel heating elements controlled by an electronic heating circuit.

Further, U.S. Pat. No. 3,391,405 to Wiswell, Jr. discloses a diving suit of the wet suit type having flexible conduits for distributing warm water therethrough and provided with a manually operable control valve for regulating the flow of warm water pumped through the conduits. However, the Wiswell, Jr. '405 patent does not have silicon gel heating elements controlled by an electronic heating circuit.

Still further, U.S. Pat. No. Des. 245,817 to Smalley discloses a dry suit. However, the Smalley '817 patent does not have silicon gel heating elements controlled by an electronic heating circuit.

Yet further, U.S. Pat. No. 3,348,236 to Copeland discloses a fluid ventilated suit that forms a unitary structure having arms, legs and torso portions and shaped to snugly enclose the arms, legs and torso. The suit has an inner resilient fluid impervious layer of material having an outer layer of pliant reinforcing material laminated thereto. There are multiple fluid distribution grooves formed in the inner layer. The grooves extend longitudinally about the arms, legs and torso portions. Fluid duct means extend longitudinally along the torso portions and along the arm and leg portions. Each arm and leg portion of the garment has a ring like continuous passageway communicating between the fluid supply duct means and the distribution grooves. A means for supplying fluid to the fluid supply duct for passage through the distribution grooves allows control of the temperature of the body. However, the Copeland '236 patent does not have silicon gel heating elements controlled by an electronic heating circuit.

Lastly, U.S. Pat. No. 3,449,761 to Long discloses a heated underwater diving suit that receives temperature controlled fluid under pressure which is distributed through a plurality of conduits covering the diving suit. The conduits and suit have multiple matching holes through which the liquid passes supplying a uniform distribution of temperature controlled fluid to the cavity of the diving suit and out the neck, wrist, and ankle openings. However, the Long '761 patent does not have silicon gel heating elements controlled by an electronic heating circuit.

While the above-described devices fulfill their respective, particular objectives and requirements, the aforementioned patents do not describe a heated underwater diving suit that allows self contained heated underwater diving suits having electronically controlled silicon gel heating elements. The Nuckols et al. '469, Parker et al. '053, Wiswell, Jr. '405, Smalley '817, Copeland '236 and Long '761 patents make no provision for silicon gel heating elements controlled by an electronic heating circuit.

Therefore, a need exists for a new and improved heated underwater diving suit which can be used for self contained heated underwater diving suits having electronically controlled silicon gel heating elements. In this regard, the present embodiment of the invention substantially fulfills this need.

In this respect, the heated underwater diving suit according to the present embodiment of the invention substantially departs from the conventional concepts and designs of the prior art, and in doing so provides an apparatus primarily developed for the purpose of self contained heated underwater diving suits having electronically controlled silicon gel heating elements.

SUMMARY OF THE INVENTION

In view of the foregoing disadvantages inherent in the known types of diving suits now present in the prior art, the present embodiment of the invention provides an improved heated underwater diving suit, and overcomes the above-mentioned disadvantages and drawbacks of the prior art. As such, the general purpose of the present embodiment of the invention, which will be described subsequently in greater detail, is to provide a new and improved heated underwater diving suit and method which has all the advantages of the prior art mentioned heretofore and many novel features that result in a heated underwater diving suit which is not anticipated, rendered obvious, suggested, or even implied by the prior art, either alone or in any combination thereof.

To attain this, the present embodiment of the invention essentially comprises an inner liquid impervious yieldable sheet. An outer liquid impervious yieldable sheet is connected to the inner sheet. The inner sheet to the outer sheet forming a cavity therebetween. A silicon gel heating element is disposed within the cavity. A heating controller is electrically connected to the silicon gel heating element for controlling the heating of the silicon gel heating element.

There has thus been outlined, rather broadly, the more important features of the embodiment of the invention in order that the detailed description thereof that follows may be better understood and in order that the present contribution to the art may be better appreciated.

The present embodiment of the invention may also include a logic circuit, a temperature sensor array, a liquid crystal display, a global positioning system, a light switch, a key pad, a temperature set switch, a power supply and a pressure release valve. There are, of course, additional features of the present embodiment of the invention that will be described hereinafter and which will form the subject matter of the claims attached.

Numerous objects, features and advantages of the present embodiment of the invention will be readily apparent to those of ordinary skill in the art upon a reading of the following detailed description of presently preferred, but nonetheless illustrative, embodiments of the present embodiment of the invention when taken in conjunction with the accompanying drawings. In this respect, before explaining the current embodiment of the embodiment of the invention in detail, it is to be understood that the embodiment of the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present embodiment of the invention.

It is therefore an object of the present embodiment of the invention to provide a new and improved heated underwater diving suit that has all of the advantages of the prior art diving suits and none of the disadvantages.

It is another object of the present embodiment of the invention to provide a new and improved heated underwater diving suit that may be easily and efficiently manufactured and marketed.

An even further object of the present embodiment of the invention is to provide a new and improved heated underwater diving suit that has a low cost of manufacture with regard to both materials and labor, and which accordingly is then susceptible of low prices of sale to the consuming public, thereby making such heated underwater diving suit economically available to the buying public.

Still another object of the present embodiment of the invention is to provide a new heated underwater diving suit that provides in the apparatuses and methods of the prior art some of the advantages thereof, while simultaneously overcoming some of the disadvantages normally associated therewith.

Even still another object of the present embodiment of the invention is to provide a heated underwater diving suit that is self contained.

Lastly, it is an object of the present embodiment of the invention is to provide a heated underwater diving suit having electronically controlled silicon gel heating elements.

These together with other objects of the embodiment of the invention, along with the various features of novelty that characterize the embodiment of the invention, are pointed out with particularity in the claims annexed to and forming a part of this disclosure. For a better understanding of the embodiment of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The embodiment of the invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
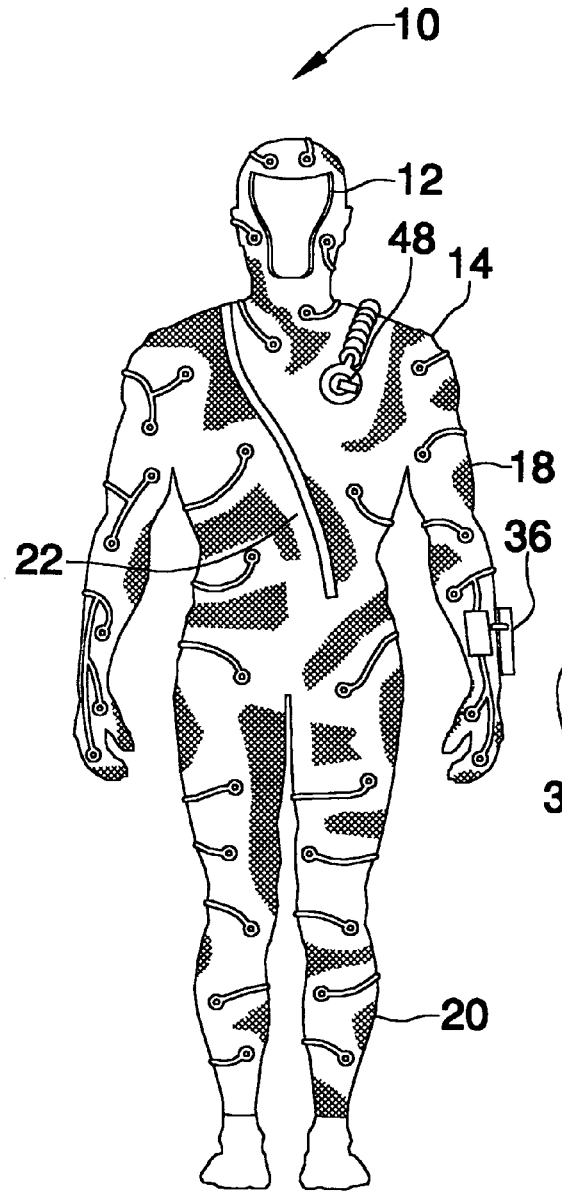
FIG. 1 is a front side view of the preferred embodiment of the heated underwater diving suit constructed in accordance with the principles of the present invention.

Referring now to the drawings, and particularly to FIGS. 1-6, a preferred embodiment of the heated underwater diving suit of the present invention is shown and generally designated by the reference numeral 10.

In FIG. 1, a new and improved heated underwater diving suit 10 of the present invention for self contained heated underwater diving suits having electronically controlled silicon gel heating elements is illustrated and will be described. More particularly, the heated underwater diving suit 10 has an inner liquid impervious yieldable sheet 12 (shown in FIG. 4). An outer liquid impervious yieldable sheet 14 is connected to the inner sheet 12. The inner sheet 12 and the outer sheet 14 forming a cavity 16 therebetween (shown in FIG. 4). The inner sheet 12 and the outer sheet 14 forms the structure having a set of arms 18, a set of legs 20 and a torso 22 portions. A silicon gel heating element 28 (shown in FIG. 4) is disposed within the cavity 16.

Figure 2:
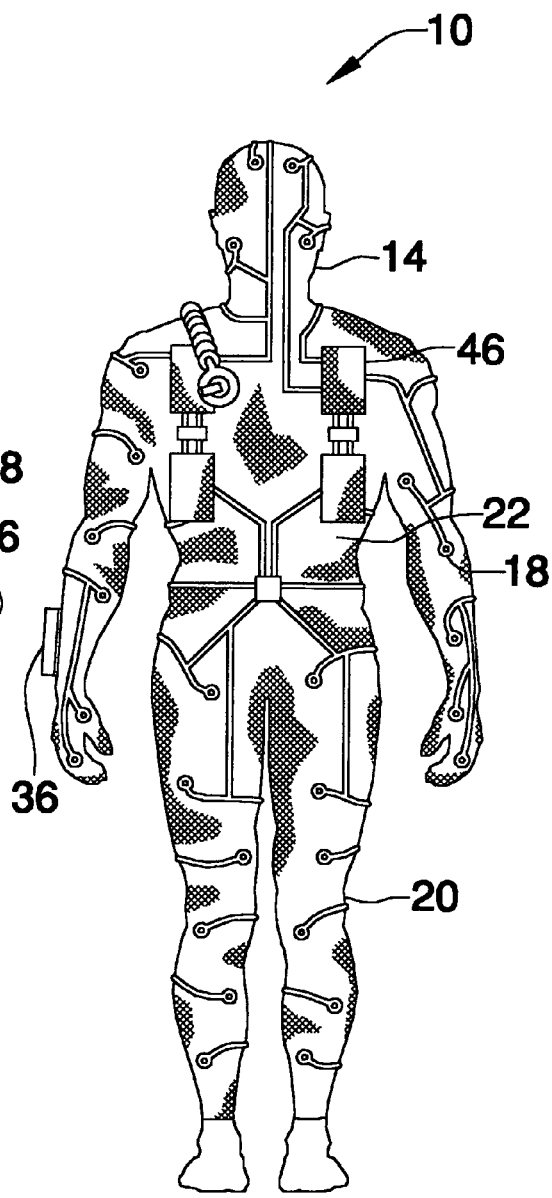
FIG. 2 is a back side view of the heated underwater diving suit of the present embodiment of the invention.

In FIG. 2, the heated underwater diving suit 10 is illustrated and will be described. The inner sheet 12 and the outer sheet 14 forms the structure having arms 18, legs 20 and torso 22 portions. A pressure release valve 48 is connected to the outer sheet 14.

Figure 3:
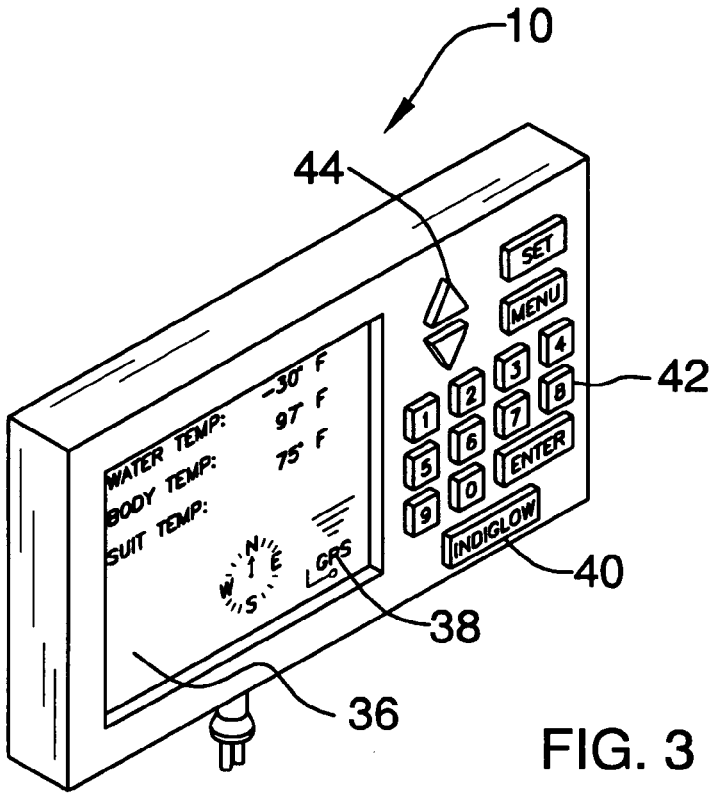
FIG. 3 is a top perspective view of the heated underwater diving suit of the present embodiment of the invention.

In FIG. 3, the heated underwater diving suit 10 is illustrated and will be described. A touch sensitive liquid crystal display 36 is electrically connected to a logic circuit 32. A global positioning system 38 is connected to the liquid crystal display 36. A light switch 40 is connected to the liquid crystal display 36. A keypad 42 is connected to the liquid crystal display 36. A temperature set switch 44 is connected to the liquid crystal display 36. A power supply 46 is electrically is connected to the logic circuit 32.

Figure 4:
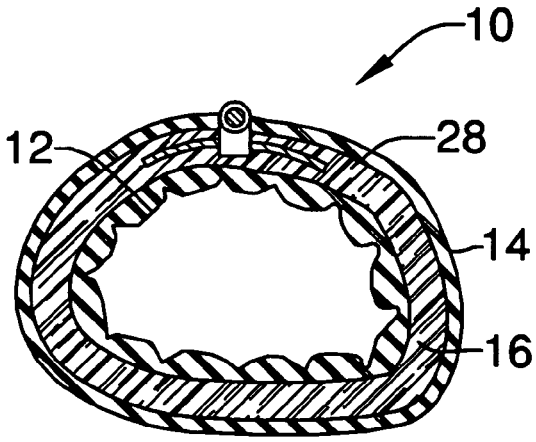
FIG. 4 is a section view of the heated underwater diving suit of the present embodiment of the invention.

In FIG. 4, the heated underwater diving suit 10 is illustrated and will be described. More particularly, the heated underwater diving suit 10 has the inner liquid impervious yieldable sheet 12. The outer liquid impervious yieldable sheet 14 is connected to the inner sheet 12. The inner sheet 12 and the outer sheet 14 forming the cavity 16 therebetween. The silicon gel heating element 28 is disposed within the cavity 16. A heating controller 30 (shown in FIG. 6) is electrically connected to the silicon gel heating element 28 for controlling the heating of the silicon gel heating element 28.

Figure 5:
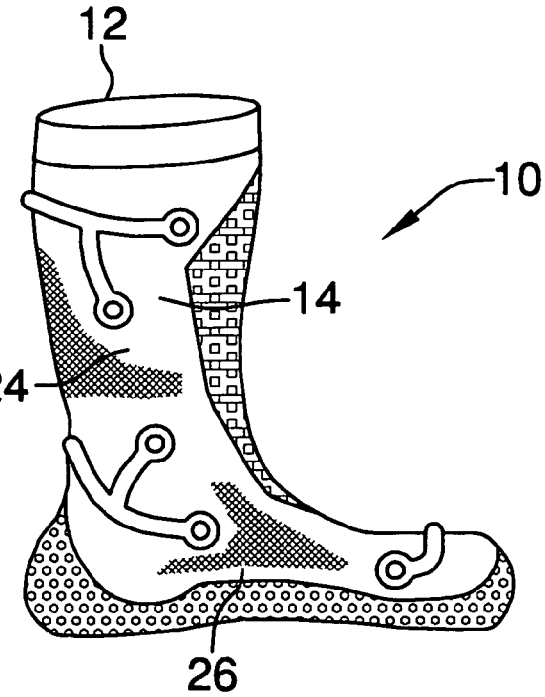
FIG. 5 is a right side view of the heated underwater diving suit of the present embodiment of the invention.

In FIG. 5, the heated underwater diving suit 10 is illustrated and will be described. More particularly, the heated underwater diving suit 10 has the inner liquid impervious yieldable sheet 12 (shown in FIG. 4). The outer liquid impervious yieldable sheet 14 is connected to the inner sheet 12. The inner sheet 12 and the outer sheet 14 forming the cavity 16 therebetween. The inner sheet 12 and outer sheet 14 form a structure having a thigh portion 24 and a foot portion 26. The silicon gel heating element 28 is disposed within the cavity 16 (shown in FIG. 4).

Figure 6:
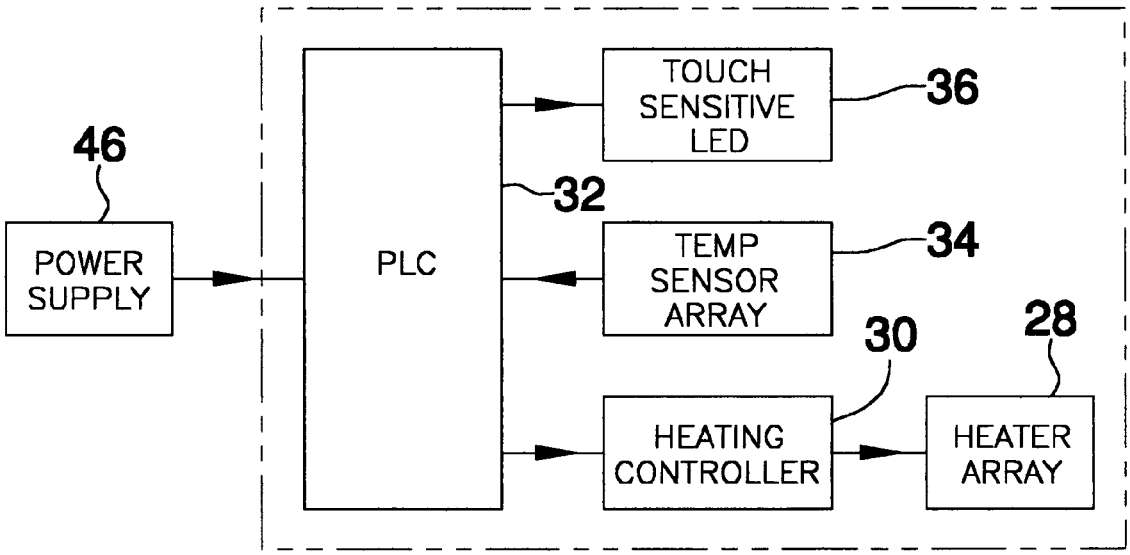
FIG. 6 is a block diagram view of the heated underwater diving suit of the present embodiment of the invention.

In FIG. 6, the heated underwater diving suit 10 is illustrated and will be described. The heating controller 30 is electrically connected to the silicon gel heating element 28 for controlling the heating of the silicon gel heating element 28. The logic circuit 32 is electrically connected to the heating controller 30. A temperature sensor array 34 is electrically connected to the logic circuit 32. The touch sensitive liquid crystal display 36 is electrically connected to the logic circuit 32. The power supply 46 is electrically is connected to the logic circuit 32.

While a preferred embodiment of the heated underwater diving suit has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present embodiment of the invention. For example, any suitable pliable water resilient material may be used instead of the rubber described. And although self contained heated underwater diving suits having electronically controlled silicon gel heating elements have been described, it should be appreciated that the heated underwater diving suit herein described is also suitable for use in any low temperature environment.

Therefore, the foregoing is considered as illustrative only of the principles of the embodiment of the invention. Further, since numerous modifications and changes will readily occur to those skilled in the art, it is not desired to limit the embodiment of the invention to the exact construction and operation shown and described, and accordingly, all suitable modifications and equivalents may be resorted to, falling within the scope of the embodiment of the invention.

I claim:

1. A heated underwater diving suit comprising:

an inner liquid impervious yieldable sheet;

an outer liquid impervious yieldable sheet, said outer sheet is connected to said inner sheet, said inner sheet to said outer sheet forming a cavity therebetween;

a silicon gel heating element disposed within said cavity; and a heating controller electrically connected to said silicon gel heating element for controlling the heating of said silicon gel heating element.

2. The heated underwater diving suit of claim 1 further comprising:

a logic circuit electrically connected to said heating controller.

3. The heated underwater diving suit of claim 2 further comprising:

a temperature sensor array electrically connected to said logic circuit.

4. The heated underwater diving suit of claim 2 further comprising:

a touch sensitive liquid crystal display electrically connected to said logic circuit.

5. The heated underwater diving suit of claim 4 further comprising:

a global positioning system connected to said liquid crystal display.

6. The heated underwater diving suit of claim 4 further comprising:

a light switch connected to said liquid crystal display.

7. The heated underwater diving suit of claim 4 further comprising:

a keypad connected to said liquid crystal display.

8. The heated underwater diving suit of claim 4 further comprising:

a temperature set switch connected to said liquid crystal display.

9. The heated underwater diving suit of claim 2 further comprising:

a power supply electrically connected to said logic circuit.

10. The heated underwater diving suit of claim 1 further comprising:

a pressure release valve connected to said outer sheet.

11. The heated underwater diving suit of claim 1 wherein:

said inner sheet and said outer sheet form a structure having arms, legs and torso portions.

12. The heated underwater diving suit of claim 1 wherein:

said inner sheet and said outer sheet form a structure having a thigh portion and a foot portion.

13. A heated underwater diving suit comprising:

an inner liquid impervious yieldable sheet, said inner sheet having an edge;

an outer liquid impervious yieldable sheet, said outer sheet is connected to said inner sheet, said inner sheet to said outer sheet forming a cavity therebetween;

a silicon gel heating element disposed within said cavity;

a heating controller electrically connected to said silicon gel heating element for controlling the heating of said silicon gel heating element; and a logic circuit electrically connected to said heating controller.

14. The heated underwater diving suit of claim 13 further comprising:

a temperature sensor array electrically connected to said logic circuit.

15. The heated underwater diving suit of claim 14 further comprising:

a touch sensitive liquid crystal display electrically connected to said logic circuit.

16. The heated underwater diving suit of claim 15 further comprising:

a global positioning system connected to said liquid crystal display.

17. The heated underwater diving suit of claim 16 further comprising:

a light switch connected to said liquid crystal display;

a keypad connected to said liquid crystal display; and a temperature set switch connected to said liquid crystal display.

18. The heated underwater diving suit of claim 17 further comprising:

a power supply electrically connected to said logic circuit.

19. The heated underwater diving suit of claim 18 further comprising:

a pressure release valve connected to said outer sheet.

20. A heated underwater diving suit comprising:

an inner liquid impervious yieldable sheet, said inner sheet having an edge;

an outer liquid impervious yieldable sheet, said outer sheet is connected to said inner sheet, said inner sheet to said outer sheet forming a cavity therebetween, said inner sheet and said outer sheet forming a structure having arms, legs and torso portions;

a silicon gel heating element disposed within said cavity;

a heating controller electrically connected to said silicon gel heating element for controlling the heating of said silicon gel heating element;

a logic circuit electrically connected to said heating controller;

a temperature sensor array electrically connected to said logic circuit;

a touch sensitive liquid crystal display electrically connected to said logic circuit;

a global positioning system connected to said liquid crystal display;

a light switch connected to said liquid crystal display;

a keypad connected to said liquid crystal display;

a temperature set switch connected to said liquid crystal display;

a power supply electrically connected to said logic circuit; and a pressure release valve connected to said outer sheet.

* * * * *